United States Patent [19]

Norris

[11] Patent Number: 4,616,915

[45] Date of Patent: Oct. 14, 1986

[54] IMMERSION TYPE FILM PROCESSING APPARATUS

[75] Inventor: Philip R. Norris, Reading, Mass.

[73] Assignee: Polaroid Corporation, Cambridge, Mass.

[21] Appl. No.: 677,090

[22] Filed: Nov. 30, 1984

[51] Int. Cl.[4] ..... G03D 3/08

[52] U.S. Cl. ..... 354/320; 354/331

[58] Field of Search ..... 354/301, 302, 319, 320, 354/321, 322, 331, 83, 84, 85, 86, 307; 352/130

[56] References Cited

U.S. PATENT DOCUMENTS

| | | | |
|---|---|---|---|
| 2,918,069 | 12/1959 | Brown et al. | 354/319 |
| 3,057,282 | 10/1962 | Luboshez | 354/301 |
| 3,120,795 | 2/1964 | Land | 354/307 |
| 3,662,660 | 5/1972 | Layne | 354/320 |
| 4,166,689 | 9/1979 | Schausberger | 354/321 |
| 4,324,479 | 4/1982 | Sachs | 354/319 |

*Primary Examiner*—A. A. Mathews

*Attorney, Agent, or Firm*—Leslie J. Payne

[57] ABSTRACT

There is disclosed a film processing apparatus having a container for fluid of the type for processing film units. Connected to the container is a sealing and transporting assembly which includes a pair of pressure-applying and sealing rollers that are operable to seal fluid in the container and transport the film into and out of the container.

4 Claims, 3 Drawing Figures

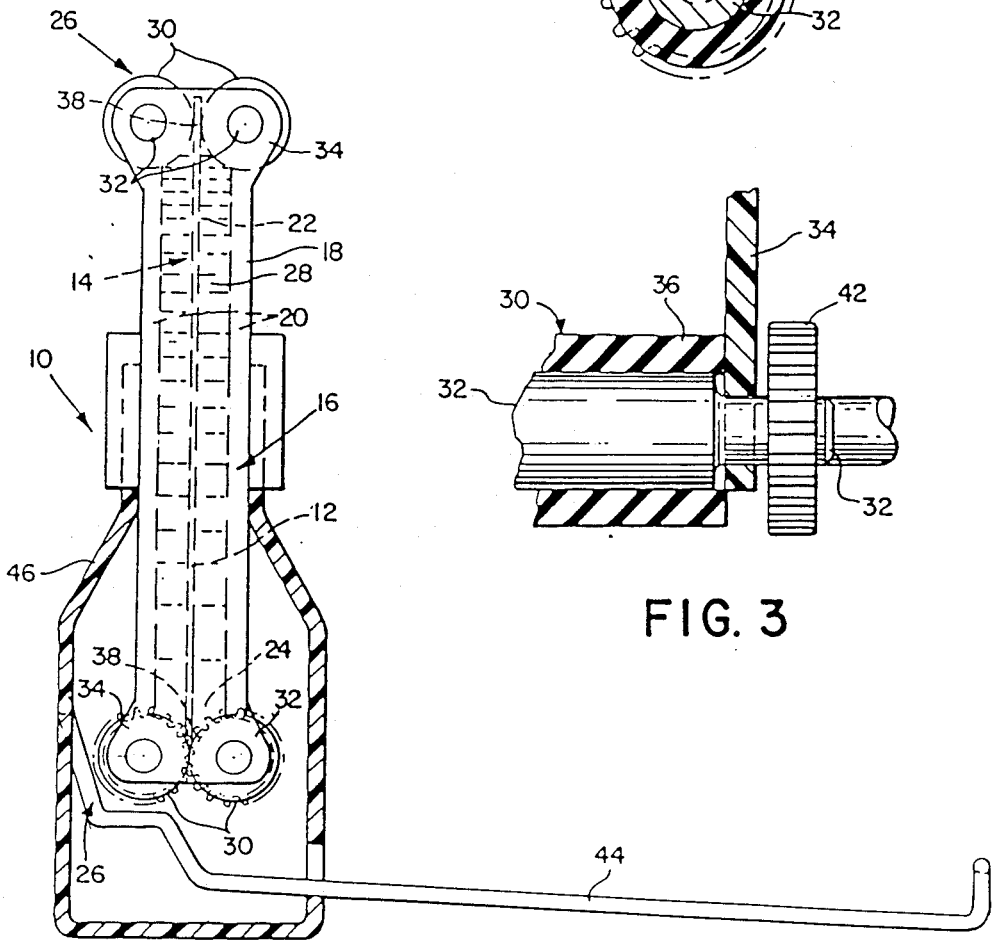
FIG. 1
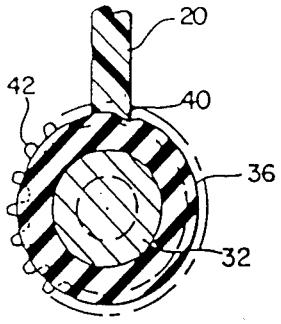
FIG. 2
FIG. 3

IMMERSION TYPE FILM PROCESSING APPARATUS

BACKGROUND OF THE INVENTION

The present invention relates generally, to the field of processing film units and, more particularly, to the processing of film units by immersing them in a processing fluid reservoir.

Systems of many kinds have been proposed for processing film units. One approach involves immersing an exposed film unit in a bath of processing liquid for initiating development thereof. In such an immersion system, a film unit enters a supply tank containing processing liquid. After being submerged in the liquid, the film unit is withdrawn from the container. Commonly assigned U.S. Pat. Nos. 3,405,619, 3,405,618; and 3,565,519 disclose examples of self-developing cameras having an immersion type processing apparatus therein. Another type of immersion system is of the so-called stand-alone type. Generally, these are for use in photographic darkrooms where the exposed film unit may be safely removed from the camera. Examples of such immersion type film processes are described generally in commonly assigned U.S. Pat. No. 3,288,609 and U.S. Pat. Nos. 3,943,539 and 4,361,392. In the foregoing systems, cooperating pairs of pressure-applying rollers are often actuated to transport the film units into or out of the processing fluid container. However, these rollers do not serve to seal the fluid within the container.

There are, however, problems associated with immersion type processing systems, especially those housing processing fluid usable in developing instant film. One is the criticality of keeping the fluid free from contaminants and others are to prevent the fluid from oxidizing or having its chemical activity diminished as a result of contact from the surrounding atmosphere. Still another is to prevent leakage of the processing liquid from its reservoir recepticle. Obviously, oxidation, contamination and loss of chemical activity diminishes the effectiveness of the processing fluid for the purposes intended.

With the exception of U.S. Pat. No. 4,361,392 the foregoing noted immersion systems employ a vertically standing container in which the film units enter and are withdrawn from the same opening. This factor limits, of course, the throughput of the systems inasmuch as successive units cannot be immersed until after the completion of the imbibition time of preceding unit.

SUMMARY OF THE INVENTION

It is an object of the present invention to overcome some of the disadvantages noted above in connection with immersion type processing apparatus of the type for processing sheets of photosensitive material. Included in the processing apparatus is a plurality of elongated wall members connected together to define an elongated open ended space which is adapted to accommodate an exposed photographic film unit. Provision is made for means for cooperating with the wall members adjacent the open end of the space to effect a fluid seal thereat. This facilitates the retention of a reservoir of photographic film processing fluid within the space and for selectively advancing an exposed fluid treated film unit from the fluid containing space. The fluid seal effecting and fluid unit advancing means comprises a pair of elongated rollers disposed in parallel relationship wherein each of the rollers include a resiliently flexible peripheral surface portion which two said peripheral surface portions being disposed in engagement one with the other which further are configured to engage the wall members to provide both a static and dynamic fluid seal adjacent the open end of the space. The rollers when actuated are adapted to withdraw therebetween a fluid treated processed film unit from the fluid containing space.

In a preferred embodiment, each of the flexible and resilient assemblies is defined by an elongated sleeve on a shaft which forms part of the rotatable sealing members. The sleeves engage each other longitudinally along a bite therebetween to define, in part, said sealing arrangement. The sleeves are elongated so as to engage surfaces of said open end portion adjacent the bite so as to facilitate providing the sealing arrangement.

In another preferred embodiment, the container assembly includes a second end open portion. In this embodiment, the fluid seal effecting and fluid unit advancing means includes a second pair of rollers. Each one of the second pair of sealing rollers includes a flexible and resilient peripheral sleeve. These sealing rollers are constructed and arranged with respect to each other and the second open end portion such that each of the sleeves define a fluid-tight bite therebetween and with the second open end portion to provide a static and dynamic sealing arrangement. The rollers when rotated cooperate to transport the film unit through the second opening and through the bite therebetween without leakage.

Among the other objects of the invention are, therefore, the provision of a film processing apparatus in which film may be processed by an immersion technique whereby film transportation rollers serve to not only transport the film, but to seal processing fluid in the container; the provision of a film processing apparatus of the last-noted type wherein each of the transporting and sealing rollers include elongated sealing assemblies; the provsion of sealing assemblies of the last noted type wherein the rollers have a fluid-tight longitudinal bite therebetween and are in fluid-tight engagement with surfaces defining the opening; and the provision of a fluid processor of the foregoing type wherein the immersion container includes another opening in communication with the reservoir and having another pair of sealing and transporting rollers cooperating therewith to allow successive film units to travel through the immersion tank.

These and other objects, features and further scope of applicability of the present invention will become apparent when taken in configuration with the accompanying drawings wherein like structure throughout the several views are indicated by like reference numerals.

FIG. 1 shows an elevational view of a fluid processing apparatus made in accordance with the present invention;

FIG. 2 is an enlarged fragmentary view in cross-section showing a sealing relationship between a sealing roller and container walls; and, FIG. 3 is an enlarged fragmentary view in cross-section showing another relationship between the rollers and the container walls.

DETAILED DESCRIPTION

Reference is now made to FIGS. 1–3 of the drawings illustrating a film processing apparatus 10 made in accordance with the present invention for processing sheet-like film units 12.

In this embodiment, the film unit 12 is a single sheet, self-developing type which includes a multilayered structure having one or more photosensitive layers (not shown) and an image receiving layer (not shown). It is assumed that the film unit 12 has been exposed by directing image forming light to one surface thereof. Thereafter, the film unit 12 will be processed by immersion in the fluid processing apparatus 10. For purposes of processing the film unit 12, there is provided an appropriate volume of an aqueous alkaline processing liquid 14 so as to allow the film unit 12 to be immersed and processed.

Reference is now made to the container assembly 16 in which the film unit 12 is immersed for treating. In the illustrated embodiment, the container assembly 16 includes an elongated parallelpiped tank 18 having opposed elongated wall members 20 which define an elongated space top and bottom open end portions 22 and 24; respectively. These end portions 22, 24 are appropriately sized to allow passage therethrough of the film units. Although in this embodiment, the container assembly 16 is shown in the vertical position it will be realized, of course, that such orientation is for purposes of illustration. The improved sealing and transporting mechanism 26 of this invention in conjunction with the tank 18 provide a fluid-tight reservoir 28 for the processing liquid 14.

Reference is now made to the sealing and transporting mechanism 26. Included in this mechanism 26 are pairs of pressure-applying sealing members or roller assemblies 30. Since each pair is identical in construction, only one will be described. Each pair includes a pair of rotatable support shafts 32 suitably journalled in flared end portions 34 of the side walls 20 and are disposed in generally parallel fashion to one another. The pairs of pressure-applying sealing rollers 30 further include resiliently flexible surface portions on sleeves 36 being disposed on the shafts 32.

In this embodiment, the resiliently flexible sleeves 36 are dimensioned so that they are in fluid-tight engagement along their longitudinal extent to define therebetween a bite 38. In this regard, the sleeves 36 are slightly compressed along the extent of the bite 38 to prevent leakage. Also, it will be observed that each of the sleeves 36 has a length sufficient for effecting a fluid-tight sealing engagement with internal surfaces of the flared end portions 34. It will be noted in FIG. 1 that the flared end portions 34 extend beyond the bite 38 of the sealing rollers 30. This insures that the liquid 14 does not leak along the ends of the sealing rollers 30.

As shown in FIG. 2, the peripheral surfaces of the sleeves 36 sealing engage scraping projections 40 extending along the bottom of each of the front and back walls 20 to provide respective edge seals. Thus, whenever the sealing rollers 30 rotate the scraping projections 40 cooperate with the former to not only prevent leakage of the liquid 14, but scrape the surfaces of the sleeves 36. The sleeves 36 are inert chemically to the liquid 14 to protect them against the corrosive effect of the liquid. In the present embodiment, the sleeves 36 are made of an elastomeric material, for example, Neoprene. This material acts as a squeegee for removing excess fluid from the fluid treated processed film unit as the latter exits the rollers. Of course, other materials having similar physical and chemical properties can be utilized.

Attached to one end of each of the shafts 32 is a respective gear 42. The gears 42 of each pair of rollers 30 drivingly mesh and can be driven through either a manual crank (not shown) or an energizable motor (not shown). Whatever mode of driving power is used, however, it will be appreciated that sealing members 30 are counter-rotated in the direction shown by the arrows to cooperate and apply compressive forces to the film unit 12 in a manner to effect driving the latter through the bite 38. Not only do the sealing rollers 30 transport the film unit 12 but advantageously serve simultaneously to create a seal to prevent leakage. Moreover, the sealing rollers 30 squeegee the excess liquid from surfaces of the unit 12 prior to exiting the tank 18.

For transporting the film unit 12, the pair of pressure-applying sealing rollers 30 at the top end portion 22 are actuated to drive the film unit 12 into the reservoir 28. Accordingly, imbibition and processing of the film unit are commenced. The sealing rollers 30 at the upper end continue to drive the film unit 12 until the latter comes into engagement with the pair of pressure-applying sealing rollers 30 at the bottom end portion 24.

These lower and upper rollers serve to drive the film unit 12 through the reservoir. In this case the upper and lower pair of rollers are spaced by a distance no greater than the length of the film unit. At the completion of a suitable imbibition period the bottom sealing rollers 30 transport the film unit 12 through their bite 38. As indicated, the sealing rollers 30 advantageously seal against fluid leakage and transport the film unit 12. The sealing rollers 30 also squeegee excess liquid from the exiting unit. Following exiting the unit 12 descends onto a film tray 44 for subsequent handling. In this embodiment, there is provided a stand 46 which provides means for mounting the film processing apparatus 10 in a generally vertical orientation.

It should be mentioned that the sealing rollers 30 provide both static and dynamic sealing arrangements with the tank 18 and themselves. Hence, oxidation, contamination and leakage of the liquid 14 is substantially eliminated whether the film processing apparatus is being operated or not. Significantly, the sealing and transporting means of the present invention is extremely simple to construct and is highly reliable in operation. Moreover, with the foregoing construction the film processing apparatus 10 can handle successive film units. This advantageously increases throughput of the processing operation insofar as successive film units need not enter and exit the same immersion tank opening before completing imbibition.

Although it has been disclosed that the film unit 12 is driven through the tank 18, it can also do so by virtue of gravity. In this regard the upper and lower pairs of pressure-applying, sealing rollers 30 are not spaced closer together than the length of the film unit 12. In the former case, of course, the respective pairs of pressure-applying rollers 30 are driven at a suitable speed by suitable means not forming part of this invention to insure that the film unit 12 has been immersed for the requisite imbibition time. It will also be realized that the tank 10 instead of being vertically oriented may be horizontally oriented.

While the foregoing embodiment has been described, it will be appreciated that other embodiments are contemplated by the present invention and that the scope of the invention should be construed by the appended claims.

What is claimed is:

1. Photographic processing apparatus comprising:

a plurality of elongated wall members connected together to define an elongated open ended space adapted to accommodate an exposed photographic film unit therein; and means for cooperating with said wall members adjacent said open end of said space defined thereby to effect a fluid seal thereat, thereby facilitating the retention of a reservoir of photographic film processing fluid within said space, and for selectively advancing an exposed fluid treated, processed film unit from said fluid containing space, said fluid seal effecting and fluid unit advancing means comprising a pair of elongated rollers disposed in parallel relationship, each of said rollers including a resiliently flexible peripheral surface portion, which two said peripheral surface portions being disposed in engagement one with the other and which further are configured to substantially exclusively engage said wall members to provide both a static and a dynamic fluid seal adjacent said open end of said space, said rollers when actuated adapted to withdraw therebetween a fluid treated, processed film unit from said fluid containing space.

2. The apparatus of claim 1 wherein said open end of said space defined by said elongated wall members is substantially rectangular in cross section and each said roller comprises a rotatably mounted shaft with its said peripheral surface portion extending to engage opposed said wall members in a fluid-tight manner with ends of the other opposed said wall members respectively engaging the circumferential edges of said peripheral surface portions of said rollers in a fluid-tight manner and to scrape said peripheral surface portions so as to remove fluid.

3. The apparatus of claim 1 wherein said peripheral surface portions of said rollers are formed of a relatively flexible and resilient material thereby functioning as a squeegee to remove excess fluid from a fluid treated, processed film unit as it passes therebetween.

4. The apparatus of claim 1 wherein said elongated wall members further define a second open end of said space disposed a given distance from its said firstmentioned open end and additionally including second means for cooperating with said wall members adjacent said second open end of said space defined thereby to effect a fluid seal thereat and for selectively advancing an exposed film unit into said space, said second means including a second pair of elongated rollers disposed in parallel relationship and spaced from said first-mentioned pair of rollers a distance less than the length of the film unit so that the leading edge of the film unit may be introduced into the bite of said first-mentioned pair of rollers prior to its trailing edge leaving the bite of said second pair of rollers.

* * * * *